US008550151B2

(12) United States Patent
Murayama et al.

(10) Patent No.: US 8,550,151 B2
(45) Date of Patent: Oct. 8, 2013

(54) HEAT EXCHANGER

(75) Inventors: Takuya Murayama, Aichi (JP); Makoto Sugiyama, Aichi (JP)

(73) Assignee: Panasonic Corporation, Osaka (JP)

( * ) Notice: Subject to any disclaimer, the term of this patent is extended or adjusted under 35 U.S.C. 154(b) by 1401 days.

(21) Appl. No.: 12/296,379

(22) PCT Filed: Apr. 16, 2007

(86) PCT No.: PCT/JP2007/058234

§ 371 (c)(1),
(2), (4) Date: Oct. 7, 2008

(87) PCT Pub. No.: WO2007/119843

PCT Pub. Date: Oct. 25, 2007

(65) Prior Publication Data

US 2009/0071638 A1 Mar. 19, 2009

(30) Foreign Application Priority Data

Apr. 17, 2006 (JP) ..... 2006-113169

(51) Int. Cl.
*F28F 3/00* (2006.01)

(52) U.S. Cl.
USPC ..... 165/133; 165/166

(58) Field of Classification Search
USPC ..... 165/133, 134.1, 135, 166; 29/890.03, 29/890.039
See application file for complete search history.

(56) References Cited

U.S. PATENT DOCUMENTS

| | | | | |
|---|---|---|---|---|
| 1,662,870 | A * | 3/1928 | Stancliffe | 165/166 |
| 4,265,806 | A | 5/1981 | Grundmann et al. | |
| 4,452,302 | A * | 6/1984 | Schoerner | 165/133 |
| 6,019,170 | A * | 2/2000 | Yokoya et al. | 165/166 |
| 6,536,514 | B1 * | 3/2003 | Sugiyama et al. | 165/166 |
| 6,686,052 | B2 * | 2/2004 | Jogan et al. | 428/472.2 |
| 7,572,321 | B2 * | 8/2009 | Yamakawa et al. | 96/11 |
| 2003/0094269 | A1 * | 5/2003 | Arai et al. | 165/166 |
| 2005/0070647 | A1 * | 3/2005 | Iyoshi et al. | 524/155 |
| 2005/0082045 | A1 * | 4/2005 | Takada et al. | 165/133 |
| 2006/0257625 | A1 * | 11/2006 | Wakizaka | 428/141 |

FOREIGN PATENT DOCUMENTS

| | | | |
|---|---|---|---|
| JP | 47-19990 | B | 6/1972 |
| JP | 53-34663 | B | 9/1978 |
| JP | 56-16554 | A | 2/1981 |
| JP | 57-207528 | A | 12/1982 |

(Continued)

OTHER PUBLICATIONS

International Search Report of PCT Application No. PCT/JP2007/058234 dated May 22, 2007.

*Primary Examiner* — Allen Flanigan
(74) *Attorney, Agent, or Firm* — Panasonic Patent Center

(57) ABSTRACT

A heat exchanger, which maintains basic performance even in an environment repeatedly subjected to dew condensation, is provided. The heat exchanger is formed of a plurality of unit devices each including a heat exchanger plate, spacer ribs, and shielding ribs. The heat exchanger plate, the spacer rib and the shielding rib are integrally molded with resin. The spacer ribs keep the spacing between the heat exchangers, and the shielding ribs shield leakage of airflow. The unit devices are stacked each other to form airflow passages between the heat exchanger plates. The airflow passages allow a first airflow and a second airflow to pass therethrough and to exchange heat through the heat exchanger plates. The heat exchanger plate is made of a moisture permeable resin film having water-insolubility and flame retardant property, and the resin has water-insolubility and flame retardant property.

11 Claims, 5 Drawing Sheets

(56) References Cited

FOREIGN PATENT DOCUMENTS

| | | | | |
|---|---|---|---|---|
| JP | 57-207795 | A | | 12/1982 |
| JP | 61-046899 | A | | 3/1986 |
| JP | 62-26498 | | | 2/1987 |
| JP | 1989-170892 | | | 12/1989 |
| JP | 6-194093 | | | 7/1994 |
| JP | 2639303 | B | | 7/1994 |
| JP | 3460358 | B | | 8/1996 |
| JP | 2005276627 | A | * | 10/2005 |
| JP | 2006-29692 | | | 2/2006 |
| JP | 2006-29692 | A | | 2/2006 |
| JP | 2006029692 | A | * | 2/2006 |
| JP | 2006-097958 | | | 4/2006 |

* cited by examiner

HEAT EXCHANGER

TECHNICAL FIELD

The present invention relates to a lamination type heat exchanger for use in a heat exchange type ventilation fan for domestic use or in a total heat exchange type ventilator for buildings or the like. The invention more particularly relates to a heat exchanger that can be used in an environment repeatedly subjected to dew condensation.

BACKGROUND ART

Some well-known conventional heat exchangers of this type are cross flow type heat exchangers using a corrugation process (see, for example, Patent Document 1 below).

Referring to the schematic perspective view of FIG. 8, a conventional heat exchanger 104 will be described.

As shown in FIG. 8, heat exchanger 104 includes a plurality of heat exchanger blocks 101 each having a heat exchanger plate 102 and a corrugated spacer plate 103 bonded thereto. The heat exchanger plate 102 is made of paper treated with a hydrophilic polymer containing a moisture absorbent such as lithium chloride. The heat exchanger blocks 101 are stacked over each other while being rotated by 90 degrees each time.

In heat exchanger 104 thus structured, a first airflow "A" and a second airflow "B" are made to pass through the spaces between heat exchanger plates 102 and spacer plates 103 in the directions of the arrows of FIG. 8. As a result, the first and second airflows "A" and "B" exchange heat through heat exchanger plates 102.

Another conventional heat exchanger of this type has moisture permeability, a gas shielding property, and a flame retardant property (see, for example, Patent Document 2 below).

The heat exchanger having moisture permeability, gas shielding property, and flame retardant property is described as follows. This heat exchanger is described with reference to FIG. 8 because it has an external shape similar to the conventional heat exchanger described above.

Heat exchanger plates 102 having moisture permeability, gas shielding property, and flame retardant property are formed as follows. First, a mixed solution is prepared by adding a guanidine salt-based flame retardant agent and an organic or inorganic moisture absorbent to an aqueous solution of a water-soluble polymeric resin. Then, the mixed solution is either impregnated or coated in flammable porous members such as Japanese paper therewith to form heat exchanger plates 102. The heat exchanger 104 including such heat exchanger plates 102 has high latent heat exchange efficiency, low migration of gas such as carbon dioxide, and an excellent flame retardant property.

The high latent heat exchange efficiency of the heat exchanger 104 is achieved due to the following reasons. The flammable porous members such as Japanese paper made of hydrophilic fibers used as the substrates of heat exchanger plates 102 allow water molecules to be absorbed and dispersed therein at high speed. In addition, the organic or inorganic moisture absorbent improves the moisture permeability of the porous members. The low migration of gas such as carbon dioxide of heat exchanger 104 is achieved by impregnating or coating the porous members with the water-soluble polymeric resin such as a polyvinyl alcohol resin, making the porous members less breathable. The excellent flame retardant property is achieved by impregnating or coating the porous members with the guanidine salt-based flame retardant agent.

Another conventional heat exchanger of this type has moisture-resistant heat exchanger plates which allow the heat exchanger to be used in an environment susceptible to dew condensation such as a cold region, a bathroom, or a heated swimming pool (see, for example, Patent Document 3 below).

The heat exchanger having moisture-resistant heat exchanger plates 108 is described as follows with reference to FIG. 9. FIG. 9 is a schematic sectional view of one of heat exchanger plates 108. This heat exchanger is described with reference to FIG. 8 because it also has an external shape similar to the heat exchanger of FIG. 8.

As shown in FIG. 9, each heat exchanger plate 108 of heat exchanger 104 consists of porous substrate 109 such as an unwoven cloth having a specific air permeability, and a moisture permeable film formed by coating water-insoluble hydrophilic polymer 110 thereon.

The moisture resistance of the heat exchanger plates 108 is achieved by using an unwoven cloth as the porous substrate 109 and also using the water-vapor permeable film as the water-insoluble hydrophilic polymer 110. This allows the heat exchanger 104 to have less shape distortion in an environment repeatedly subjected to dew condensation.

Another conventional heat exchanger of this type has heat exchanger plates each made of a composite moisture permeable film in order to resist deformation, maintain performance for a long time, and has high latent heat exchange efficiency in an environment susceptible to dew condensation (see, for example, Patent Document 4).

The heat exchanger having the heat exchanger plates each made of the composite moisture permeable film is described as follows with reference to FIG. 10. FIG. 10 is a schematic sectional view of one of the heat exchanger plates 116. This heat exchanger is described with reference to FIG. 8 because it also has an external shape similar to the heat exchanger of FIG. 8.

As shown in FIG. 10, each heat exchanger plate 116 is a composite moisture permeable film consisting of a fibrous porous sheet 112, a hydrophilic polymer thin film 113, and a porous film 114 disposed therebetween. The fibrous porous sheet 112 is water-insoluble and highly breathable. The hydrophilic polymer thin film 113 is water-insoluble and water-vapor permeable. The porous film 114 is water-insoluble and has smaller diameter pores than the fibrous porous sheet 112. The heat exchanger 104 is formed as follows. First, each heat exchanger block 101 is formed by bonding the spacer plate 103 and heat exchanger plate 116 together by applying an adhesive (unillustrated) to the peaks on one side of corrugated spacer plate 103. Then, the peaks on the other side of corrugated spacer plate 103 on the heat exchanger block 101 are applied with the adhesive (unillustrated). Finally, heat exchanger blocks 101 are stacked on each other while being rotated by 90 degrees each time.

In each heat exchanger plate 116 of conventional heat exchanger 104, the water-insoluble hydrophilic polymer thin film 113, which is moisture permeable and the main contributor to gas shielding, is formed on the highly breathable fibrous porous sheet 112 with the porous film 114 interposed therebetween. This structure allows hydrophilic polymer thin film 113 to be sufficiently thin, and at the same time, to avoid pinholes or peeling. As a result, the heat exchanger 104 has a low gas migration rate and a high latent heat exchange efficiency. In addition, heat exchanger plates 116 made of the water-insoluble materials allow the heat exchanger 104 to resist deformation and maintain performance for a long time in an environment susceptible to dew condensation.

Another conventional heat exchanger of this type has heat exchanger plates each made of a composite film and spacer plates each made of a composite film in order to improve the mass production and the basic performance of the heat exchangers in addition to the above-described performance (see, for example, Patent Document 5 below).

The heat exchanger having heat exchanger blocks 127 is described as follows with reference to FIG. 11. Each of the heat exchanger blocks 127 has a heat exchanger plate and a spacer plate which are each made of a composite film. FIG. 11 is a schematic sectional view of one of heat exchanger blocks 127. This heat exchanger is described with reference to FIG. 8 because it also has an external shape similar to the heat exchanger of FIG. 8.

As shown in FIG. 11, each spacer plate 120 is formed by joining a thin film 121 having an air shielding property to a porous material 122, and then joining the thin film 121 to an adhesive layer 123 exhibiting adhesion when softened by heat. In this specification, "to join films" means "to bring films into close structural contact with each other" by being superimposed upon each other, bonded to each other, or subjected to a process such as heat sealing or lamination.

Each heat exchanger plate 124, on the other hand, is formed by joining hydrophilic polymer thin film 125 to porous material 122, and then joining thereto ground fabric 126. Hydrophilic polymer thin film 125 is water-insoluble and water-vapor permeable. Ground fabric 126 is breathable and thicker than the combined thickness of porous material 122 and hydrophilic polymer thin film 125. The heat exchanger 104 of Patent Document 5 is formed as follows. First, each heat exchanger block 127 is formed by bonding spacer plate 120 and heat exchanger plate 124 together with adhesive layer 123. Then, the corrugated peaks of heat exchanger blocks 127 are applied with an adhesive (unillustrated). Finally, heat exchanger blocks 127 are stacked over each other while being rotated by 90 degrees each time.

The bonding between spacer plates 120 and heat exchanger plates 124 is performed by using adhesive layer 123 which exhibits adhesion when softened by heat. This provides heat exchanger 104 with, in addition to the above-described performance, the advantage of being manufactured by heat sealing which has fast initial bonding strength. As a result, heat exchanger blocks 127 can be bonded quickly and continuously. In the process of bonding the heat exchanger blocks 127 by applying the adhesive (unillustrated) to the peaks of the corrugated spacer plates 120, the adhesive easily enters porous materials 122 of the spacer plates 120 and provides an anchor effect. When the heat exchanger 104 is in use, the anchor effect increases the bonding strength between the heat exchanger blocks 127, making the spacer plates 120 and heat exchanger plates 124 harder to be separated from each other. In addition, the thin films 121 having air shielding property of spacer plates 120 prevent gas migration, that is, air leakage to the outside. The porous materials 122 are easy to cut and the heat exchanger blocks 127 are firmly bonded to each other. Accordingly, these features facilitate cutting the heat exchanger 104, where heat exchanger blocks 127 are stacked, and the manufactured heat exchanger 104 has a desired size.

Conventional heat exchanger 104 having moisture permeability, gas shielding property, and a flame retardant property, however, has the following drawbacks. Heat exchanger plates 102 are formed by impregnating or coating the flammable porous members such as Japanese paper with the mixed solution prepared by adding the guanidine salt-based flame retardant agent and the organic or inorganic moisture absorbent to the aqueous solution of the water-soluble polymeric resin. In an environment repeatedly subjected to dew condensation, however, the water-soluble polymeric resin impregnated or coated in the porous members therewith gradually elutes in water because of its water solubility, thereby deteriorating the gas shielding property. Moreover, the guanidine salt-based flame retardant agent and the organic or inorganic moisture absorbent also gradually elute in water from the porous members, thereby deteriorating the moisture permeability and the flame retardant property. Therefore, there is a need for a heat exchanger which, in an environment repeatedly subjected to dew condensation, prevents deterioration due to dew condensation water, retains the components of the heat exchanger plates, and maintains basic performance such as moisture permeability, gas shielding property, and a flame retardant property.

On the other hand, conventional heat exchanger 104 having moisture-resistant heat exchanger plates 108 has the following drawbacks. Heat exchanger plates 108 each consist of porous substrate 109 such as an unwoven cloth having high air permeability and the moisture permeable film formed thereon by coating water-insoluble hydrophilic polymer 110. This structure requires water-insoluble hydrophilic polymer 110 to be thick, causing a reduction in the moisture permeability and hence the latent heat exchange efficiency. In contrast, if hydrophilic polymer 110 is thinner, this reduces the bonding strength between porous substrate 109 and the moisture permeable film of water-insoluble hydrophilic polymer 110. As a result, the moisture permeable film becomes susceptible to peeling, pinholes, and airflow leakage, thereby degrading the basic performance of the heat exchanger. Therefore, there is a need for a heat exchanger which, in an environment repeatedly subjected to dew condensation, prevents deterioration due to dew condensation water, prevents peeling of the heat exchanger plates, and maintains basic performance such as airflow leakage prevention. In conventional heat exchangers, the corrugated thickness of spacer plates 103 and 120 causes the airflow passages in heat exchanger plates 102, 108, 116, and 124 to have a small effective area and hence high ventilation resistance. Therefore, there is a need for a heat exchanger which has low ventilation resistance.

Conventional heat exchanger 104 having heat exchanger plates 116 each made of the composite moisture permeable film has the following drawbacks. Heat exchanger blocks 101 each consist of heat exchanger plate 116 and corrugated spacer plate 103 whose peaks are applied with the adhesive so as to be bonded to heat exchanger plate 116. This structure makes spacer plates 103 have a large contact area with heat exchanger plates 116, so that the adhesive applied to spacer plates 103 causes heat exchanger plates 116 to have a smaller effective area for water vapor permeation. The effective area for water vapor permeation in heat exchanger plates 116 is further reduced by the adhesive applied to the corrugated peaks of heat exchanger blocks 101 to stack them on top of each other so as to form heat exchanger 104. This causes a reduction in the latent heat exchange efficiency. Therefore, there is a need for a heat exchanger having high latent heat exchange efficiency.

Conventional heat exchanger 104 having heat exchanger plates 124 each made of a composite film and spacer plates 120 each made of a composite film has the following drawbacks. The bonding between spacer plates 120 and heat exchanger plates 124 is performed by using adhesive layer 123 which exhibits adhesion when softened by heat. This allows heat exchanger 104 to be manufactured by heat sealing which has fast initial bond strength. In heat exchanger blocks 127, only the peaks of spacer plates 120 are bonded to heat exchanger plates 124. As a result, the effective area for water-vapor permeation is less reduced than in heat exchanger 104 having heat exchanger blocks 101 in which only heat exchanger plates 116 are each made of the composite moisture permeable film. However, the bonding between heat exchanger blocks 127 is performed by applying the water-soluble adhesive to the peaks of corrugated spacer plates 120. The water-soluble adhesive, which is slow to cure and highly fluid, seeps to the heat transfer surfaces of heat exchanger plates 124 from the upper peaks of spacer plates 120. This reduces the effective area for water vapor permeation in heat exchanger plates 124, and hence the latent heat exchange efficiency. Therefore, there is a need for a heat exchanger having high latent heat exchange efficiency.

Patent Document 1: Japanese Patent Examined Publication No. S47-19990

Patent Document 2: Japanese Patent Examined Publication No. S53-34663

Patent Document 3: Japanese Patent No. 1793191

Patent Document 4: Japanese Patent No. 2639303

Patent Document 5: Japanese Patent No. 3460358

SUMMARY

An object of the present invention is to provide a heat exchanger which, in an environment repeatedly subjected to dew condensation, prevents deterioration due to dew condensation water, retains the components of heat exchanger plates, and maintains basic performance such as moisture permeability, gas shielding property, and flame retardant property. Another object of the present invention is to provide a heat exchanger which, in an environment repeatedly subjected to dew condensation, prevents deterioration due to dew condensation water, prevents peeling of heat exchanger plates, maintains basic performance such as airflow leakage prevention, and improves basic performance such as ventilation resistance, sensible heat exchange efficiency, latent heat exchange efficiency, and airflow leakage.

Therefore, one aspect of the present invention is a heat exchanger which includes a heat exchanger plate, spacer ribs, and shielding ribs. The heat exchanger plate is integrally molded with the spacer ribs and the shielding ribs from resin, the spacer ribs keeping the spacing between the heat exchanger plates, and the shielding ribs shielding leakage of airflow. The unit devices are stacked over each other to form airflow passages between the heat exchanger plates. The airflow passages allow a first airflow and a second airflow to pass therethrough and to exchange heat through the heat exchanger plates. The heat exchanger plates are each made of a moisture permeable resin film having water-insolubility and a flame retardant property, and the resin has water-insolubility and a flame retardant property.

Another aspect of the present invention is a heat exchanger which, in an environment repeatedly subjected to dew condensation, prevents deterioration due to dew condensation water, and maintains basic performance. Another aspect of the present invention is a heat exchanger which, in an environment repeatedly subjected to dew condensation, prevents deterioration due to dew condensation water, retains the components of the heat exchanger plates, and maintains basic performance such as moisture permeability, gas shielding property, and flame retardant property.

Another aspect of the present invention is a heat exchanger which, in an environment repeatedly subjected to dew condensation, prevents deterioration due to dew condensation water, prevents peeling of heat exchanger plates, and maintains basic performance such as airflow leakage prevention. Another aspect of the present invention is a heat exchanger which improves basic performance such as ventilation resistance, sensible heat exchange efficiency, and latent heat exchange efficiency.

REFERENCE MARKS IN THE DRAWINGS

Figure 1:
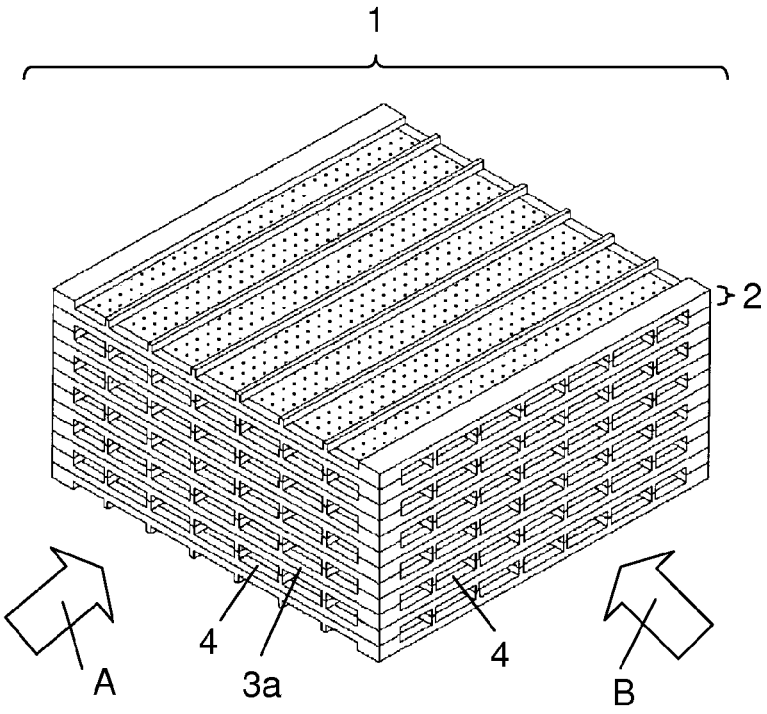
FIG. 1 is a schematic perspective view of a heat exchanger according to a first embodiment of the present invention.

1 heat exchanger
2 unit device
3*a*, 3*b*, 3*c*, 3*d*, 102, 108, 116, 124 heat exchanger plate
4 airflow passage
5*a*, 5*b* spacer rib
6*a*, 6*b* shielding rib
7*b* moisture permeable resin film
11 porous resin film
12*a* hydrophilic moisture permeable resin film
13 porous resin substrate

DETAILED DESCRIPTION OF PREFERRED EMBODIMENTS

A heat exchanger according to the present invention includes a heat exchanger plate, spacer ribs, and shielding ribs. The heat exchanger plate is integrally molded with the spacer ribs and the shielding ribs from resin, the spacer ribs keeping the spacing between the heat exchanger plates, and the shielding ribs shielding leakage of airflow. The unit devices are stacked over each other to form airflow passages between the heat exchanger plates. The airflow passages allow a first airflow and a second airflow to pass therethrough and to exchange heat through the heat exchanger plates. The heat exchanger plates are each made of a moisture permeable resin film having water-insolubility and a flame retardant property. The resin has water-insolubility and a flame retardant property.

This structure provides a heat exchanger which, in an environment repeatedly subjected to dew condensation, prevents deterioration due to dew condensation water and maintains basic performance. This structure also provides a heat exchanger which, in an environment repeatedly subjected to dew condensation, prevents deterioration due to dew condensation water, maintains a flame retardant property, and improves basic performance such as ventilation resistance, latent heat exchange efficiency, and airflow leakage.

The moisture permeable resin film may be a two-layer moisture permeable resin film formed by joining a hydrophilic moisture permeable resin film having water-insolubility, a flame retardant property, and gas shielding property to a surface of a porous resin film having water-insolubility and flame retardant property.

This structure provides a heat exchanger which, in an environment repeatedly subjected to dew condensation, prevents deterioration due to dew condensation water, prevents peeling of heat exchanger plates, and maintains basic performance such as airflow leakage prevention. This structure also provides a heat exchanger which, in an environment repeatedly subjected to dew condensation, prevents deterioration due to dew condensation water, retains the components of heat exchanger plates, maintains basic performance such as moisture permeability, gas shielding property, and flame retardant property, and improves basic performance such as sensible heat exchange efficiency, latent heat exchange efficiency, and airflow leakage.

The moisture permeable resin film may be a three-layer composite moisture permeable resin film formed by joining a porous resin substrate having water-insolubility, flame retardant property, and breathability to the other surface of the porous resin film.

This structure provides a heat exchanger which, in an environment repeatedly subjected to dew condensation, prevents deterioration due to dew condensation water, prevents peeling of heat exchanger plates, and maintains basic performance such as airflow leakage prevention. This structure also provides a heat exchanger which, in an environment repeatedly subjected to dew condensation, prevents deterioration due to dew condensation water, retains the components of heat exchanger plates, maintains basic performance such as moisture permeability, gas shielding property, and flame retardant property, and improves basic performance such as sensible heat exchange efficiency, latent heat exchange efficiency, and airflow leakage.

The moisture permeable resin film may be a three-layer composite moisture permeable resin film formed by joining a porous resin substrate having water-insolubility, flame retardant property, and breathability to a surface of the hydrophilic moisture permeable resin film.

This structure provides a heat exchanger which improves basic performance such as latent heat exchange efficiency and airflow leakage.

The hydrophilic moisture permeable resin film of the three-layer composite moisture permeable resin film may be a hydrophilic moisture permeable resin film having water-insolubility and gas shielding property.

This structure provides a heat exchanger which, in an environment repeatedly subjected to dew condensation, prevents deterioration due to dew condensation water, retains the components of heat exchanger plates, and maintains basic performance such as moisture permeability, gas shielding property, and flame retardant property.

The three-layer composite moisture permeable resin film may be formed by roughening the surface of the hydrophilic moisture permeable resin film and joining the porous resin substrate to the roughened surface of the hydrophilic moisture permeable resin film.

This structure provides a heat exchanger which, in an environment repeatedly subjected to dew condensation, prevents deterioration due to dew condensation water, prevents peeling of heat exchanger plates, and maintains basic performance such as airflow leakage prevention.

The roughened surface of the hydrophilic moisture permeable resin film of the three-layer composite moisture permeable resin film may be obtained by an electric discharge machining process.

This structure provides a heat exchanger which, in an environment repeatedly subjected to dew condensation, prevents deterioration due to dew condensation water, prevents peeling of heat exchanger plates, and maintains basic performance such as airflow leakage prevention.

The moisture permeable resin film may be a three-layer composite moisture permeable resin film formed by spot gluing the porous resin substrate to the surface of the hydrophilic moisture permeable resin film using a waterproof adhesive.

This structure provides a heat exchanger which, in an environment repeatedly subjected to dew condensation, prevents deterioration due to dew condensation water, prevents peeling of the heat exchanger plates, and maintains basic performance such as airflow leakage prevention.

The porous resin film may be made of polytetrafluoroethylene.

This structure provides a heat exchanger which, in an environment repeatedly subjected to dew condensation, prevents deterioration due to dew condensation water, retains the components of heat exchanger plates, maintains basic performance such as moisture permeability, gas shielding property, and flame retardant property, and improves basic performance such as sensible heat exchange efficiency, latent heat exchange efficiency, and airflow leakage.

The porous resin substrate may be made of a flame retardant unwoven cloth.

This structure provides a heat exchanger which, in an environment repeatedly subjected to dew condensation, prevents deterioration due to dew condensation water, retains the components of heat exchanger plates, maintains basic performance such as moisture permeability, gas shielding property, and flame retardant property, and improves basic performance such as sensible heat exchange efficiency, latent heat exchange efficiency, and airflow leakage.

The flame retardant unwoven cloth may be formed by kneading a flame retardant agent into the resin fibers thereof.

This structure provides a heat exchanger which, in an environment repeatedly subjected to dew condensation, prevents deterioration due to dew condensation water, retains the components of heat exchanger plates, and maintains the basic performance such as moisture permeability, gas shielding property, and flame retardant property.

First Embodiment

A first embodiment of the present invention is described as follows with reference to FIGS. 1 through 4.

Figure 2:
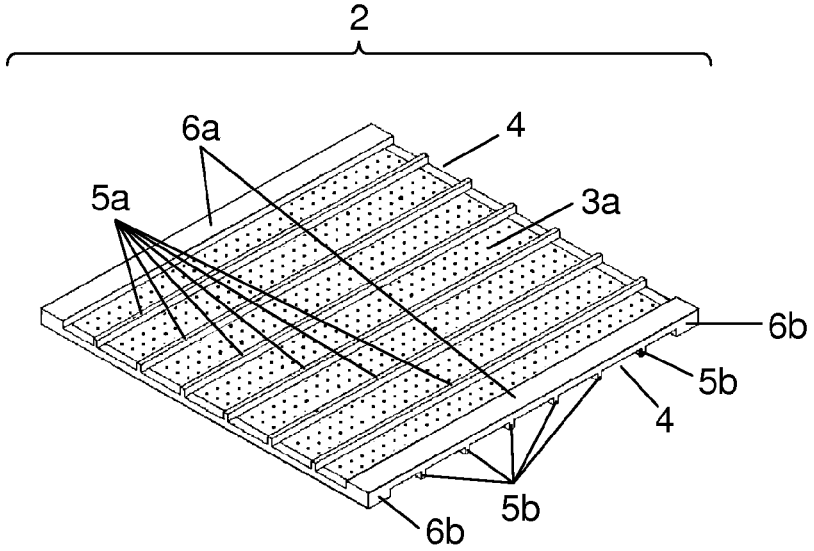
FIG. 2 is a schematic perspective view of a unit device of the heat exchanger.
Figure 3:
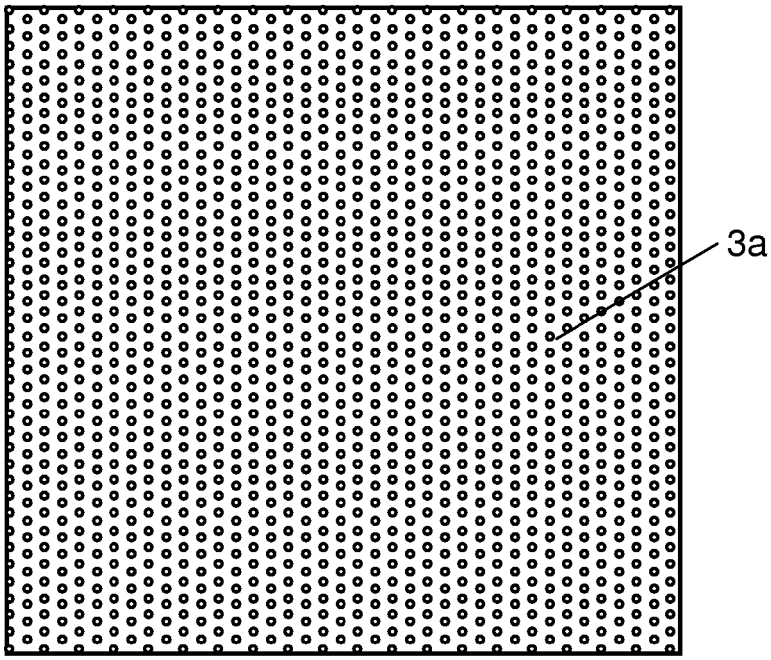
FIG. 3 is a schematic plan view of a heat exchanger plate of the heat exchanger.
Figure 4:
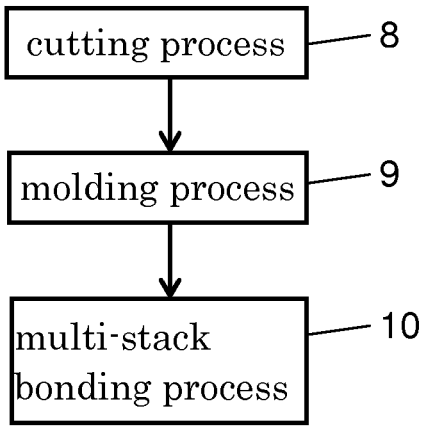
FIG. 4 is a schematic production flowchart of the heat exchanger.

FIG. 1 is a schematic perspective view of a heat exchanger 1 of the first embodiment, FIG. 2 is a schematic perspective view of a unit device of the heat exchanger 1, FIG. 3 is a schematic plan view of a heat exchanger plate of the heat exchanger 1, and FIG. 4 is a schematic production flowchart of the heat exchanger 1.

As shown in FIGS. 1, 2, and 3, the heat exchanger 1 is formed by stacking and bonding a plurality of unit devices 2 on top of each other while being rotated by 90 degrees each time. Each unit device 2 is a square 120 mm on a side and 2 mm thick and includes heat exchanger plate 3*a*. Heat exchanger plates 3*a* have airflow passages 4 through which a first airflow "A" and a second airflow "B" are made to pass in the directions of the arrows of FIG. 1. The first and second airflows "A" and "B" meet at right angles and exchange heat through heat exchanger plates 3*a*.

As shown in FIG. 2, each unit device 2 has spacer ribs 5*a* and shielding ribs 6*a* on one side of heat exchanger plate 3*a*, and spacer ribs 5*b* and shielding ribs 6*b* on the other side. Each unit device 2 is formed by molding heat exchanger plate 3*a* integrally with the spacer ribs 6*a* and shielding ribs 6*a* on one side of the heat exchanger plate 3*a* and the spacer ribs 5*b* and shielding ribs 6*b* on the other side from water-insoluble flame retardant resin.

One side of the heat exchanger plate 3*a* is provided with six spacer ribs 6*a* of 1 mm in height and width at predetermined intervals, and two shielding ribs 6*a* of 1 mm high and 5 mm wide at opposite ends of heat exchanger plate 3*a* in parallel to spacer ribs 5*a*.

The other side of the heat exchanger plate 3*a* is provided with six spacer ribs 5*b* of 1 mm in height and width at the predetermined intervals at right angles to spacer ribs 5*a*, and two shielding ribs 6*b* of 1 mm high and 5 mm wide at opposite ends of heat exchanger plate 3*a* in parallel to spacer ribs 5*a*.

As shown in FIG. 1, spacer ribs 5*a* and 5*b* are designed so that spacer ribs 5*a* are in contact with vertically adjacent spacer ribs 5*b* when unit devices 2 are stacked over each other while being rotated by 90 degrees each time. Thus, spacer ribs 5*a* and 5*b* have the function of holding heat exchanger plate 3*a* with a fixed spacing. In the present first embodiment, spacer ribs 5*a* and 5*b* can have a height of 1 mm, which means that heat exchanger plates 3*a* are stacked with a spacing of 2 mm.

As shown in FIG. 1, shielding ribs 6*a* and 6*b* are designed so that shielding ribs 6*a* are in contact with vertically adjacent shielding ribs 6*b* when the unit devices 2 are stacked over each other while being rotated by 90 degrees each time. Thus, shielding ribs 6*a* and 6*b* have the functions of holding heat exchanger plate 3*a* with a fixed spacing and preventing the first and second airflows "A" and "B" passing through airflow passages 4 from leaking from the edges of heat exchanger 1.

As mentioned above, shielding ribs 6*a* and 6*b* are arranged at both ends of a square-shaped unit device 2 in order to maximize the effective area of heat exchanger plates 3*a* in a constant volume of the heat exchanger 1. Alternatively, the width of shielding ribs 6*a* and 6*b* can be increased to improve the design or mass production of the heat exchanger.

In FIG. 3, the heat exchanger plate 3*a* is made of a water-insoluble moisture permeable resin film which has a thickness of 0.2 to 0.01 mm and preferably 0.1 to 0.01 mm and also has heat conductivity, moisture permeability, a gas shielding property, and a flame retardant property. The water-insoluble moisture permeable resin film can be formed into either a porous resin sheet or an imperforate resin sheet which are prepared as follows. The porous resin sheet is prepared by treating PP, PE, PET, PTFE, ether-based polyurethane, or the like to render it water-insoluble. The imperforate resin sheet is prepared by treating ether-based polyurethane- or polyester-based resin, or the like to render it water-insoluble. When the porous resin sheet or the imperforate resin sheet is molded, a flame retardant agent is added and kneaded thereinto. The flame retardant agent can be a halide such as chlorine or bromine, a phosphorus-based compound, a nitrogen-based compound, antimony, or a boron-based inorganic compound. The flame retardant agent thus kneaded remains in the moisture permeable resin film used for heat exchanger plate 3*a* without elution into dew condensation water in a humid environment repeatedly subjected to dew condensation.

The heat exchanger plate 3*a* of FIG. 3 can more specifically be a moisture permeable resin film which is formed into a flame retardant imperforate resin sheet by treating ether-based polyester-based resin to render it water-insoluble. The resin sheet is a square 118 mm on a side and 0.05 mm thick.

Heat exchanger plate 3*a* is integrally molded with the water-insoluble flame retardant resin used for spacer ribs 5*a*, 5*b* and shielding ribs 6*a*, 6*b* so as to form unit device 2. Therefore, the moisture permeable resin film used for heat exchanger plate 3*a* and the resin used for spacer ribs 5*a*, 5*b* and shielding ribs 6*a*, 6*b* are preferably made of the same or similar resins to each other, and more preferably made of thermosetting resins. Using thermosetting resins for heat exchanger plate 3*a* and spacer ribs 5*a*, 5*b* and shielding ribs 6*a*, 6*b* facilitates the thermal adhesion therebetween. As a result, the number of manufacturing processes of heat exchanger 1 is reduced to improve the mass production. Furthermore, heat exchanger plate 3*a* is integrally molded with the resin used for spacer ribs 5*a*, 5*b* and shielding ribs 6*a*, 6*b* without using a third material such as an adhesive. This frees heat exchanger 1 from the problem due to an adhesive as described above with the conventional heat exchanger using the corrugation process. In the conventional heat exchanger, the adhesive applied to the upper peaks of the corrugated spacer plates seeps from the peaks and causes a decrease in the effective area for water vapor permeation in the heat exchanger plates. In heat exchanger 1, on the other hand, the heat transfer surfaces have a large effective area for water vapor permeation, thereby improving latent heat exchange efficiency.

FIG. 4 shows the production flowchart of heat exchanger 1 including a cutting process 8, a molding process 9, and a multi-stack bonding process 10.

In the cutting process 8, the heat exchanger plate 3*a* is cut in size.

In the molding process 9, heat exchanger plates 3*a* thus cut are inserted into an injection molding machine, and subjected to insert injection molding so as to be integrally molded with the resin used for spacer ribs 5*a*, 5*b* and shielding ribs 6*a*, 6*b*, thereby obtaining unit device 2. The resin can be a water-insoluble flame retardant thermosetting resin, for example, polyester or polystyrene-based ABS, AS, or PS, or polyolefin-based PP or PE. Particularly among them, the PP, PE, PET, urethane or the like, which are based on the same or similar resin to the water-insoluble moisture permeable resin film used for heat exchanger plates 3*a*, are preferable. When the resin material for spacer ribs 5*a*, 5*b* and shielding ribs 6*a*, 6*b* is molded, a flame retardant agent is added and kneaded into the resin material. The flame retardant agent can be a halide such as chlorine or bromine, a phosphorus-based compound, a nitrogen-based compound, antimony, or a boron-based inorganic compound. The flame retardant agent thus kneaded remains in spacer ribs 5*a*, 5*b* and shielding ribs 6*a*, 6*b* injection molded from the resin material without elution into dew condensation water in a humid environment repeatedly subjected to dew condensation. The thermosetting resin may be further added with an inorganic filler of either glass fibers or carbon fibers at a 1 to 50 wt % and preferably 10 to 30 wt % of the resin weight. Adding the inorganic filler to the resin improves not only the physical properties of unit devices 2 such as high strength, low warpage, and high shrinkability as resin moldings but also the adhesiveness between heat exchanger plates 3*a* and the resin used for spacer ribs 5*a*, 5*b* and shielding ribs 6*a*, 6*b* when integrally molded with each other. This improvement in adhesiveness is not due to chemical bonding, but due to physical bonding resulting from fiber entanglement between the inorganic filler and heat exchanger plate 3*a*. An increase in the amount of the inorganic filler added to the resin improves the physical properties of unit devices 2 such as high strength, low warpage, and high shrinkability of the resin moldings. When it is 50 wt % or more, however, the resin melted in the injection molding decreases in fluidity, possibly making it impossible to shape the resin moldings as desired. Therefore, the amount of the inorganic filler to be added is determined according to the required strength or physical properties of the resin moldings, the specification of the injection molding machine, or other conditions. In the present first embodiment, the water-insoluble moisture permeable resin film used for heat exchanger plates 3*a* is made of a polyester-based resin. Therefore, the water-insoluble flame retardant polyester-based resin used for the injection molding of spacer ribs 5*a*, 5*b* and shielding ribs 6*a*, 6*b* is added with 10 wt % of glass fibers.

In multi-stack bonding process 10, unit devices 2 are stacked over each other while being rotated by 90 degrees each time. Before the stacking, the resin surfaces of unit devices 2 are melted by heat sealing with a heater block, ultrasonic bonding with ultrasonic vibration, or other bonding techniques. In this process, adjacent unit devices 2 are fixedly bonded to obtain the heat exchanger 1. The surfaces of unit devices 2 made of the thermosetting resin are melted by being subjected to the heater block or the ultrasonic vibration. Then, when the surfaces are cooled, adjacent unit device 2 are bonded to each other. In this specification, "to bond unit devices 2" means to fixedly bond adjacent unit devices 2.

As described above, heat exchanger 1 is formed of unit devices 2 each having heat exchanger plate 3*a* of the water-insoluble flame retardant moisture permeable resin film, and spacer ribs 5*a*, 5*b* and shielding ribs 6*a*, 6*b* of the water-insoluble flame retardant moisture permeable resin. This structure allows heat exchanger 1 to resist deformation and degradation in performance or flame retardant property in a humid environment. As a result, heat exchanger 1 maintains basic performance and flame retardant property without deterioration due to dew condensation water in an environment repeatedly subjected to dew condensation. When the water-insoluble moisture permeable resin film used for heat exchanger plates 3*a* is formed into the resin sheet, the flame retardant agent is added and kneaded into the resin sheet. The flame retardant agent thus kneaded remains in the moisture permeable resin film without elution into dew condensation water in a humid environment repeatedly subjected to dew condensation. In the same manner, when the resin material is injection molded into spacer ribs 5*a*, 5*b* and shielding ribs 6*a*, 6*b*, the flame retardant agent is added and kneaded into the resin material. The flame retardant agent thus kneaded remains in spacer ribs 5*a*, 5*b* and shielding ribs 6*a*, 6*b* without elution into dew condensation water in a humid environment repeatedly subjected to dew condensation.

Spacer ribs 5*a* and 5*b* of heat exchanger 1 are arranged on heat exchanger plates 3*a* at larger intervals than corrugated spacer plates 103 of conventional heat exchanger 104 using the corrugation process. This reduces the area ratio of spacer ribs 5*a* and 5*b* in heat exchanger plates 3*a*, allowing airflow passages 4 to have a large effective opening area. As a result, the ventilation resistance is reduced without changing the heat exchange efficiency.

The small area ratio of spacer ribs 5*a* and 5*b* in heat exchanger plates 3*a* allows a large effective area for water vapor permeation in the heat transfer surfaces and high large latent heat exchange efficiency. In addition, unit devices 2 can be formed by the integral molding of heat exchanger plate 3*a* with the resin used for spacer ribs 5*a*, 5*b* and shielding ribs 6*a*, 6*b* without using a third material such as an adhesive. This frees heat exchanger 1 from the problems due to an adhesive as described above with conventional heat exchanger 104 using the corrugation process. In the conventional heat exchanger, the adhesive applied to the upper peaks of corrugated spacer plates 103 seeps from the peaks and causes a decrease in the effective area for water vapor permeation in heat exchanger plates 3*a*. In heat exchanger 1, on the other hand, the heat transfer surfaces have a large effective area for water vapor permeation, thereby improving latent heat exchange efficiency.

Shielding ribs 6*a* and 6*b* of unit devices 2 disposed on the edges of heat exchanger 1 prevent the leakage of the first and second airflows "A" and B" passing through airflow passages 4 of heat exchanger 1.

In the present first embodiment, each unit device 2 is formed by molding heat exchanger plate 3*a* integrally with spacer ribs 5*a* and shielding ribs 6*a* on one side of heat exchanger plate 3*a* and spacer ribs 5*b* and shielding ribs 6*b* on the other side from the resin. Unit devices 2 are stacked over each other while being rotated by 90 degrees each time, and adjacent unit devices 2 are bonded to form a hexahedral heat exchanger 1. Alternatively, however, the same effect can be obtained by using a heat exchanger having other shapes or other techniques as long as it has the following fundamental structure. Unit devices are formed by molding the heat exchanger plates integrally with spacer ribs for fixing the spacing between the heat exchanger plates and shielding ribs for preventing the leakage of airflow using the resin. The unit devices are stacked over each other to form airflow passages between the heat exchanger plates. Then, the airflow passages allow a first airflow and a second airflow to pass therethrough and to exchange heat through the heat exchanger plates.

In the multi-stack bonding process 10, before adjacent unit devices 2 are stacked and fixedly bonded to each other, their resin surfaces are melted by heat sealing with the heater block, ultrasonic bonding with ultrasonic vibration, or other bonding techniques. Alternatively, unit devices 2 can be united together by forming through holes in the resin portions of unit devices 2, inserting support bars through the through holes, and providing stoppers at both ends of each support bar. The support bars can be made of a thermosetting resin, so that both ends thereof can be melted by heat and solidified with unit devices 2 tightly cramped. In this specification, "to unite unit devices 2" means to fix unit devices 2 by mechanical binding.

Second Embodiment

Figure 5:
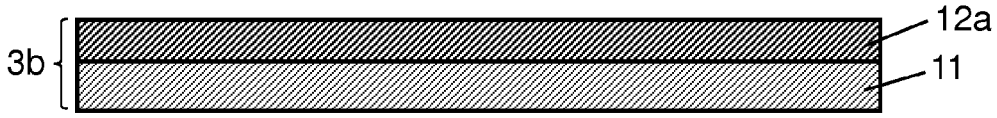
FIG. 5 is a schematic sectional view of a heat exchanger plate of a heat exchanger according to a second embodiment of the present invention.

A second embodiment of the present invention is described as follows with reference to FIG. 5. FIG. 5 is a schematic sectional view of one of heat exchanger plates 3*b* of a heat exchanger of the second embodiment.

Like components are labeled with like reference numerals and assumed to have the same effect as their equivalents with respect to the first embodiment, so that the description thereof is omitted.

Each heat exchanger plate 3*b* is a two-layer moisture permeable resin film formed by joining hydrophilic moisture permeable resin film 12*a* to a surface of porous resin film 11. Porous resin film 11 is water-insoluble and flame retardant. Hydrophilic moisture permeable resin film 12*a* has water-insolubility, flame retardant property, and gas shielding property. Porous resin film 11 is a porous sheet of PP, PE, PET, PTFE, or the like. Particularly among them, PTFE (polytetrafluoroethylene) is preferable because it has small pores, a high porosity, a small thickness, stability to water, heat resistance, and aflame retardant property. On the other hand, hydrophilic moisture permeable resin film 12*a* having water-insolubility, flame retardant property, and gas shielding property can be, for example, an ether-based polyurethane- or polyester-based resin. When porous resin film 11 or hydrophilic moisture permeable resin film 12*a* is molded, a flame retardant agent is added and kneaded thereinto. The flame retardant agent can be a halide such as chlorine or bromine, a phosphorus-based compound, a nitrogen-based compound, antimony, or a boron-based inorganic compound. The flame retardant agent thus kneaded remains in the moisture permeable resin film which forms heat exchanger plate 3*b* without elution into dew condensation water in a humid environment repeatedly subjected to dew condensation.

Heat exchanger plate 3*b* of FIG. 5 can more specifically be a two-layer moisture permeable resin film formed by joining 0.01 mm thick hydrophilic moisture permeable resin film 12*a* of the ether-based polyurethane- or polyester-based resin to a surface of 0.02 mm thick porous resin film 11 of PTFE. In this specification, "to join films" means "to bring films, that is, porous resin film 11 and hydrophilic moisture permeable resin film 12*a*, into close structural contact with each other" by being superimposed upon each other, bonded to each other, or subjected to a process such as heat sealing or lamination.

In heat exchanger plate 3*b* with the above-described structure, water-insoluble porous resin film 11 functions as the base of the moisture permeable resin film. This allows hydrophilic moisture permeable resin film 12*a* having moisture permeability, water-insolubility, and gas shielding property joined to the base to be thin. As a result, the two-layer moisture permeable resin film which forms heat exchanger plate 3*b* has low gas migration, high heat transfer performance, and low water vapor permeation resistance. Therefore, heat exchanger 1 prevents airflow leakage and improves the sensible heat exchange efficiency and the latent heat exchange efficiency.

Porous resin film 11 has a large number of fine pores, allowing the resin of hydrophilic moisture permeable resin film 12*a* to enter the pores so as to provide an anchor effect. The anchor effect increases the joint strength of the two-layer moisture permeable resin film which forms heat exchanger plate 3*b*. As a result, heat exchanger plate 3*b* resists peeling so as to maintain the basic performance of the moisture permeable resin film for a long time. If the moisture permeable resin film consists only of hydrophilic moisture permeable resin film 12*a* and is used in an environment repeatedly subjected to dew condensation, the hydrophilic moisture permeable resin film 12*a* can be rapidly hydrolyzed and degraded after being swollen due to continuous absorption of moisture. In contrast, the two-layer moisture permeable resin film which forms heat exchanger plate 3*b* resists swelling due to moisture absorption by joining hydrophilic moisture permeable resin film 12*a* to the base of porous resin film 11. As a result, heat exchanger 1, in an environment repeatedly subjected to dew condensation, prevents deterioration due to dew condensation water, prevents peeling of heat exchanger plates 3*b*, and maintains basic performance such as airflow leakage prevention.

The two-layer moisture permeable resin film which forms the heat exchanger plate 3*b* consists of a porous resin film 11 and a hydrophilic moisture permeable resin film 12*a*, both of which have water-insolubility and flame retardant property. This allows heat exchanger 1, in an environment repeatedly subjected to dew condensation, to resist deterioration due to dew condensation water, to retain the components of heat exchanger plates 3*b*, and to maintain basic performance such as moisture permeability, gas shielding property, and flame retardant property. When the porous resin film 11 and hydrophilic moisture permeable resin film 12*a* which form the two-layer moisture permeable resin film as heat exchanger plate 3*b* are molded, a flame retardant agent is added and kneaded thereinto. The flame retardant agent thus kneaded remains in the two-layer moisture permeable resin film which forms heat exchanger plate 3*b* without elution into dew condensation water in a humid environment repeatedly subjected to dew condensation.

As described above, the porous material of polytetrafluoroethylene can be formed into a thin film having small pores and a high porosity. Therefore, porous resin film 11 of polytetrafluoroethylene functions as the base of the moisture permeable resin film which forms heat exchanger plate 3*b*. This allows hydrophilic moisture permeable resin film 12*a* having gas shielding property and moisture permeability joined to the base to be extremely thin. As a result, the two-layer moisture permeable resin film which forms heat exchanger plate 3*b* has low gas migration, high heat transfer performance, and low water vapor permeation resistance. Therefore, heat exchanger 1 prevents airflow leakage and improves the sensible heat exchange efficiency and the latent heat exchange efficiency.

The porous material of polytetrafluoroethylene is stable to water, heat resistant, and flame retardant. These features allow heat exchanger 1, in an environment repeatedly subjected to dew condensation, to resist deterioration due to dew condensation water and to retain the components of heat exchanger plates 3*b*, and to maintain basic performance such as moisture permeability, gas shielding property, and flame retardant property.

Third Embodiment

Figure 6:
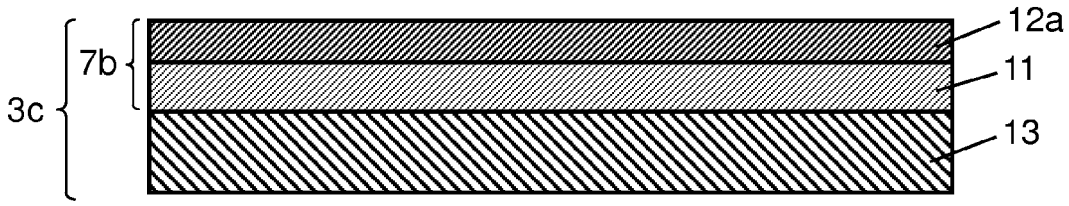
FIG. 6 is a schematic sectional view of a heat exchanger plate of a heat exchanger according to a third embodiment of the present invention.
Figure 7:
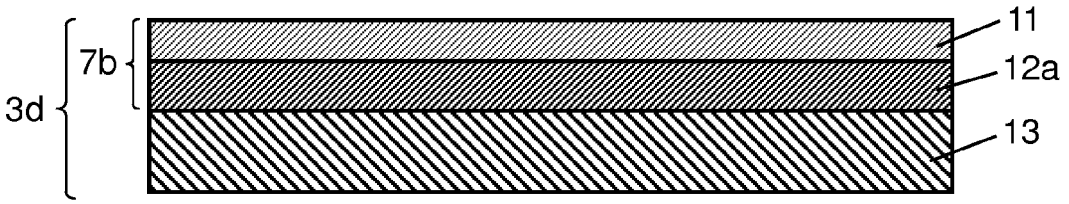
FIG. 7 is a schematic sectional view of another heat exchanger plate of the heat exchanger according to the third embodiment of the present invention.
Figure 8:
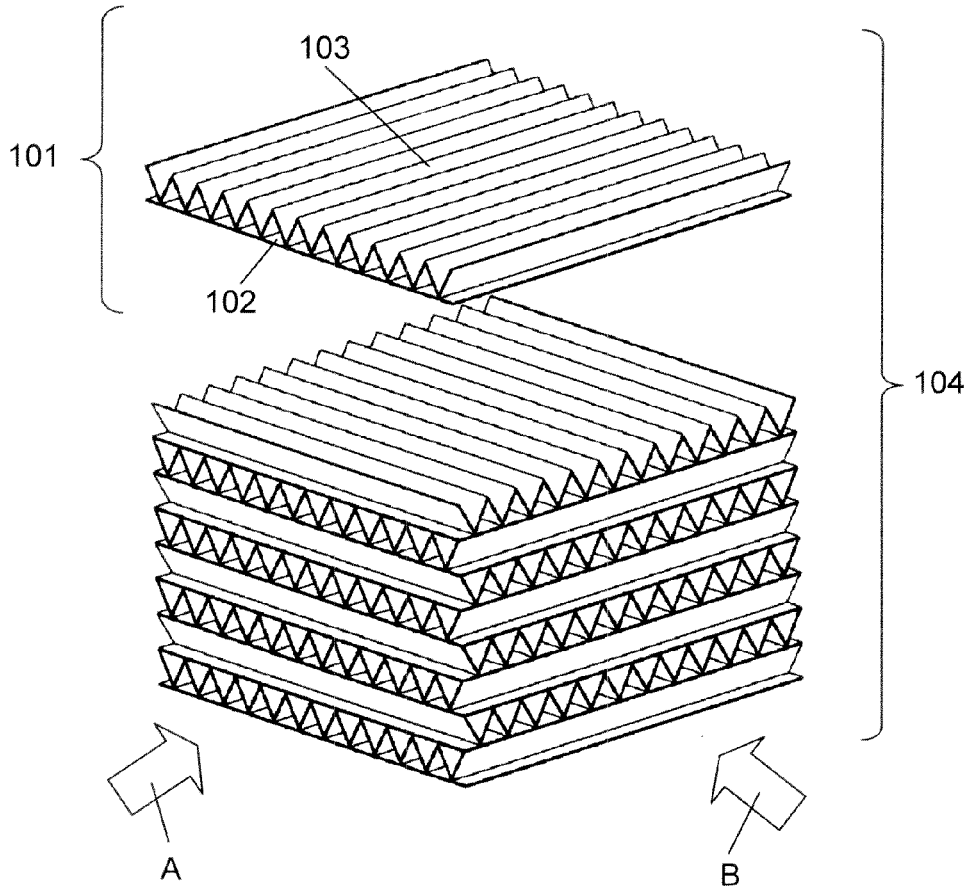
FIG. 8 PRIOR ART
FIG. 8 is a schematic perspective view of a conventional heat exchanger.
Figure 9:
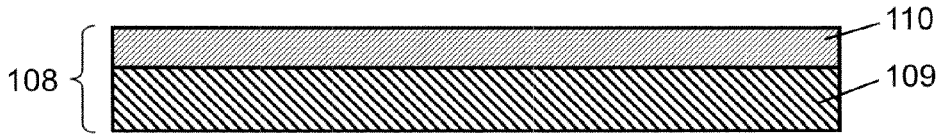
FIG. 9 PRIOR ART
FIG. 9 is a schematic sectional view of a heat exchanger plate of another conventional heat exchanger.
Figure 10:
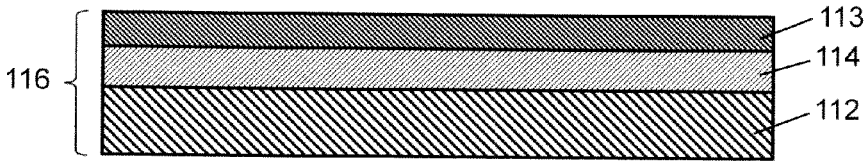
FIG. 10 PRIOR ART
FIG. 10 is a schematic sectional view of a heat exchanger plate of another conventional heat exchanger.
Figure 11:
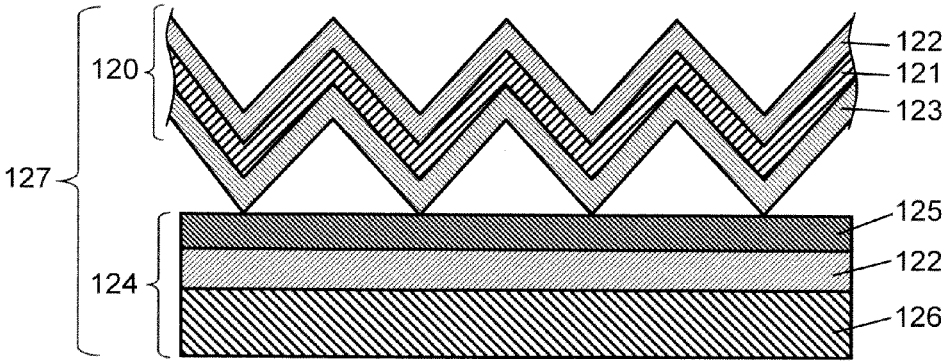
FIG. 11 PRIOR ART
FIG. 11 is a schematic sectional view of a heat exchanger block of another conventional heat exchanger.

A third embodiment of the present invention is described as follows with reference to FIGS. 6 and 7. FIG. 6 is a schematic sectional view of one of heat exchanger plates 3*c* of a heat exchanger of the third embodiment, and FIG. 7 is a schematic sectional view of one of heat exchanger plates 3*d* of the heat exchanger.

Like components are labeled with like reference numerals and assumed to have the same effect as their equivalents with respect to the first and second embodiments, so that the description thereof is omitted. Heat exchanger plate 3*c* of FIG. 6 is a three-layer composite moisture permeable resin film consisting of two-layer moisture permeable resin film 7*b* of the second embodiment and porous resin substrate 13, which is breathable, water-insoluble, and flame retardant. The three-layer composite moisture permeable resin film is more specifically formed by joining hydrophilic moisture permeable resin film 12*a* having water-insolubility, flame retardant property, and gas shielding property to a surface of porous resin film 11 having water-insolubility and flame retardant property, and further joining a porous resin substrate 13 to the other surface of the porous resin film 11.

Porous resin substrate 13 having water-insolubility, flame retardant property, and breathability can be a flame retardant unwoven cloth made of a thermosetting resin such as a polyester-based resin like PET or a polyolefin-based resin like PP or PE. The unwoven cloth has a basis weight of 10 to 100 $g/m^2$, and preferably 15 to 40 $g/m^2$, and preferably has as small a thickness as possible to satisfy the strength as a substrate.

Breathable porous resin substrate 13 made of the flame retardant unwoven cloth is hardly affected by the heat exchange for controlling temperature and humidity because the resin fibers of the unwoven cloth are spaced at large distances from each other. When the unwoven cloth is molded into porous resin substrate 13, a flame retardant agent is added and kneaded into the resin fibers of the unwoven cloth. The flame retardant agent can be a halide such as chlorine or bromine, a phosphorus-based compound, a nitrogen-based compound, antimony, or a boron-based inorganic compound.

Porous resin substrate 13 is more specifically an unwoven cloth of PET having a basis weight of 30 g/m$^2$ and a thickness of 0.1 mm. The joining of two-layer moisture permeable resin film 7*b* and porous resin substrate 13 is performed by heat sealing. The heat sealing allows the fibers of the unwoven cloth of porous resin substrate 13 to enter the fine pores of PTFE of porous resin film 11. This anchor effect increases the joint strength and prevents film peeling so as to maintain basic performance for a long time.

Heat exchanger plate 3*d* of FIG. 7, on the other hand, is another three-layer composite moisture permeable resin film including the two-layer moisture permeable resin film 7*b* of the second embodiment and the porous resin substrate 13, which is breathable, water-insoluble, and flame retardant. The three-layer composite moisture permeable resin film is more specifically formed by joining hydrophilic moisture permeable resin film 12*a* having water-insolubility, flame retardant property, and gas shielding property to a surface of porous resin film 11 having water-insolubility and flame retardant property, and further joining porous resin substrate 13 to the surface of hydrophilic moisture permeable resin film 12*a*.

Porous resin substrate 13 is more specifically an unwoven cloth of PET having a basis weight of 30 g/m$^2$ and a thickness of 0.1 mm. The joining of the two-layer moisture permeable resin film 7*b* and porous resin substrate 13 is performed by heat sealing.

When the three-layer composite moisture permeable resin film as heat exchanger plate 3*d* is formed, the surface of hydrophilic moisture permeable resin film 12*a* of two-layer moisture permeable resin film 7*b* may be roughened, and then porous resin substrate 13 is joined to the roughened surface. The surface roughening is achieved by an electric discharge machining process. The roughening by the electric discharge machining process is performed to an extent to prevent pinholes in hydrophilic moisture permeable resin film 12*a*, which is made of an ether-based polyurethane- or polyester-based resin with a small thickness of 0.01 mm. As a result, the bonding surface area between hydrophilic moisture permeable resin film 12*a* and porous resin substrate 13 can be increased while maintaining basic performance such as moisture permeability, gas shielding property, and flame retardant property. Thus, the three-layer composite moisture permeable resin film which forms heat exchanger plate 3*d* increases the joint strength and prevents film peeling so as to maintain the basic performance of the composite moisture permeable resin film for a long time. This allows heat exchanger 1, in an environment repeatedly subjected to dew condensation, to resist deterioration due to dew condensation water and to prevent peeling of heat exchanger plates 3*d* so as to maintain basic performance such as airflow leakage prevention.

In the three-layer composite moisture permeable resin film which forms heat exchanger plate 3*d*, porous resin substrate 13 may be spot-glued to the surface of hydrophilic moisture permeable resin film 12*a* of two-layer moisture permeable resin film 7*b* by using a waterproof adhesive. The adhesive of the glued spots prevents water vapor permeation. Therefore, the spot gluing is performed to an extent sufficient for preventing peeling of hydrophilic moisture permeable resin film 12*a* and porous resin substrate 13 so as to minimize a decrease in the effective area for water vapor permeation in heat exchanger plate 3*d*. This allows the three-layer composite moisture permeable resin film which forms heat exchanger plate 3*d* to have high bond strength while maintaining latent heat exchange efficiency.

The waterproof adhesive prevents film peeling in a humid environment so as to maintain the basic performance of the composite moisture permeable resin film for a long time. As a result, heat exchanger 1, in an environment repeatedly subjected to dew condensation, prevents deterioration due to dew condensation water, prevents peeling of heat exchanger plates 3*d*, and maintains basic performance such as airflow leakage prevention.

Alternatively, hydrophilic moisture permeable resin film 12*a* of the three-layer composite moisture permeable resin film which forms heat exchanger plate 3*d* may be non-flame retardant, while having water-insolubility and gas shielding property.

Porous resin substrate 13 made of the unwoven cloth having water-insolubility, flame retardant property, and breathability is hardly affected by the heat exchange for controlling temperature and humidity because the resin fibers of the unwoven cloth are spaced at large distances from each other. Porous resin substrate 13 is provided to maintain the strength of heat exchanger plate 3*c* or 3*d*. As a result, in heat exchanger plate 3*c* or 3*d* which forms the three-layer composite moisture permeable resin film, two-layer moisture permeable resin film 7*b* which performs heat exchange has a small thickness to improve heat exchange efficiency.

When molding porous resin film 11, the hydrophilic moisture permeable resin film 12*a*, and porous resin substrate 13 of the three-layer composite moisture permeable resin film which forms heat exchanger plate 3*c* or 3*d*, a flame retardant agent is added and kneaded thereinto. The flame retardant agent can be a halide such as chlorine or bromine, a phosphorus-based compound, a nitrogen-based compound, antimony, or a boron-based inorganic compound. The flame retardant agent thus kneaded remains in the three-layer composite moisture permeable resin film without elution into dew condensation water in a humid environment repeatedly subjected to dew condensation.

The three-layer composite moisture permeable resin film which forms heat exchanger plate 3*d* may have a non-flame retardant hydrophilic moisture permeable resin film in the middle of the layers. This is because flame retardant porous resin film 11 on one side and flame retardant porous resin substrate 13 on the other side protect the non-flame retardant hydrophilic moisture permeable resin film from combustible materials. In other words, the three-layer composite moisture permeable resin film which forms heat exchanger plate 3*d* has excellent flame retardant property without treating the hydrophilic moisture permeable resin film to render it flame retardant. As a result, heat exchanger 1, in an environment repeatedly subjected to dew condensation, prevents deterioration due to dew condensation water, retains the components of heat exchanger plate 3*d*, and maintains basic performance such as moisture permeability, gas shielding property, and flame retardant property.

Porous resin substrate 13, which has water-insolubility, flame retardant property, and breathability, functions to maintain the strength of heat exchanger plate 3*c* or 3*d*. This can reduce the thickness of two-layer moisture permeable resin film 7*b* which functions to shield gas and perform heat exchange for controlling temperature and humidity. Therefore, the three-layer composite moisture permeable resin film which forms heat exchanger plate 3*c* or 3*d* has low gas migration, high heat transfer performance, and low water vapor permeation resistance. As a result, heat exchanger 1 prevents airflow leakage and improves the sensible heat exchange efficiency and the latent heat exchange efficiency.

Porous resin film 11 has a large number of fine pores, allowing the resin of porous resin substrate 13 to enter the pores so as to provide an anchor effect. The anchor effect increases the joint strength of the three-layer composite moisture permeable resin film which forms heat exchanger plate 3*c*. This allows heat exchanger plate 3*c* to resist peeling so as to maintain the basic performance of the composite moisture permeable resin film for a long time. As a result, heat exchanger 1, in an environment repeatedly subjected to dew condensation, prevents deterioration due to dew condensation water, prevents peeling of heat exchanger plates 3*c*, and maintains basic performance such as airflow leakage prevention.

The three-layer composite moisture permeable resin film which forms heat exchanger plate 3*d* has porous resin film 11 on one side and porous resin substrate 13 on the other side. The resin, which is used for spacer ribs 5*a*, 5*b* and shielding ribs 6*a*, 6*b* to be integrally molded with heat exchanger plate 3*d*, enters the pores so as to provide an anchor effect, thereby increasing the adhesion between heat exchanger plate 3*d* and the resin. Thus, airflow passages 4 formed of heat exchanger plates 3*d* and the resin are shielded between the first airflow and the second airflow. As a result, the three-layer composite moisture permeable resin film which forms heat exchanger plate 3*d* prevents airflow leakage.

As described above, the integral molding of heat exchanger plate 3*d* with the resin used for spacer ribs 5*a*, 5*b* and shielding ribs 6*a*, 6*b* can be performed without using a third material such as an adhesive. This frees heat exchanger 1 from the problem due to an adhesive as described above with conventional heat exchanger 104 using the corrugation process. In conventional heat exchanger 104, the adhesive applied to the upper peaks of the corrugated spacer plates 103 seeps from the peaks and causes a decrease in the effective area for water vapor permeation in the heat exchanger plate 102. In heat exchanger 1, on the other hand, heat exchanger plates 3*d* have a large effective area for water vapor permeation, thereby improving latent heat exchange efficiency.

Roughening the surface of hydrophilic moisture permeable resin film 12*a* of two-layer moisture permeable resin film 7*b* by the electric discharge machining process increases the bonding surface area between hydrophilic moisture permeable resin film 12*a* and porous resin substrate 13. This increases the joint strength of the three-layer composite moisture permeable resin film which forms heat exchanger plate 3*d*. The increased joint strength prevents film peeling so as to maintain the basic performance of the composite moisture permeable resin film for a long time. This allows heat exchanger 1, in an environment repeatedly subjected to dew condensation, to resist deterioration due to dew condensation water, to prevent peeling of heat exchanger plates 3*d*, and to maintain basic performance such as airflow leakage prevention.

The spot gluing of porous resin substrate 13 to hydrophilic moisture permeable resin film 12*a* of two-layer moisture permeable resin film 7*b* using the waterproof adhesive minimizes a decrease in the effective area for water vapor permeation in heat exchanger plate 3*d*. This allows the three-layer composite moisture permeable resin film which forms heat exchanger plate 3*d* to increase the bond strength without a decrease in latent heat exchange efficiency. The waterproof adhesive prevents film peeling in a humid environment so as to maintain the basic performance of the three-layer composite moisture permeable resin film which forms heat exchanger plate 3*d* for a long time. As a result, heat exchanger 1, in an environment repeatedly subjected to dew condensation, prevents deterioration due to dew condensation water, prevents peeling of heat exchanger plates 3*d*, and maintains basic performance such as airflow leakage prevention.

The three-layer composite moisture permeable resin film which forms heat exchanger plate 3*c* or 3*d* consists of porous resin film 11, hydrophilic moisture permeable resin film 12*a*, and porous resin substrate 13, all of which are water-insoluble and flame retardant. As a result, heat exchanger 1, in an environment repeatedly subjected to dew condensation, prevents deterioration due to dew condensation water, retains the components of heat exchanger plate 3*c* or 3*d*, and maintains basic performance such as moisture permeability, gas shielding property, and flame retardant property.

The flame retardant agent is added and kneaded into each of porous resin film 11, hydrophilic moisture permeable resin film 12*a*, and porous resin substrate 13 of the three-layer composite moisture permeable resin film which forms heat exchanger plate 3*c* or 3*d*. The flame retardant agent thus kneaded remains in the three-layer composite moisture permeable resin film without elution into dew condensation water in a humid environment repeatedly subjected to dew condensation. This allows the three-layer composite moisture permeable resin film which forms heat exchanger plate 3*c* or 3*d* to maintain basic performance such as moisture permeability, gas shielding property, and flame retardant property.

The three-layer composite moisture permeable resin film which forms heat exchanger plate 3*d* may have a non-flame retardant hydrophilic moisture permeable resin film in the middle of the layers. This is because flame retardant porous resin film 11 on one side and flame retardant porous resin substrate 13 on the other side protect the non-flame retardant hydrophilic moisture permeable resin film from combustible materials. In other words, the three-layer composite moisture permeable resin film which forms heat exchanger plate 3*d* has excellent flame retardant property without treating the hydrophilic moisture permeable resin film to render it flame retardant. As a result, heat exchanger 1, in an environment repeatedly subjected to dew condensation, prevents deterioration due to dew condensation water, retains the components of heat exchanger plate 3*d*, and maintains basic performance such as moisture permeability, gas shielding property, and flame retardant property.

Porous resin substrate 13 is made of the unwoven cloth having water-insolubility, flame retardant property, and breathability. This allows heat exchanger 1, in an environment repeatedly subjected to dew condensation, to resist degradation dew condensation water, to retain the components of heat exchanger plates 3*c* or 3*d*, and to maintain basic performance such as moisture permeability, gas shielding property, and flame retardant property.

When the unwoven cloth is formed into porous resin substrate 13, the flame retardant agent is kneaded into the water-insoluble resin fibers, so that the components of porous resin substrate 13 are maintained in a humid environment. This allows heat exchanger 1, in an environment repeatedly subjected to dew condensation, to resist deterioration due to dew condensation water, to retain the components of heat exchanger plates 3*c* or 3*d*, and to maintain basic performance such as moisture permeability, gas shielding property, and flame retardant property.

Industrial Applicability

The heat exchanger of the present invention is useful as a lamination type heat exchanger for use in a heat exchange type ventilation fan for domestic use or in a total heat exchange type ventilator for buildings or the like. The heat exchanger is particularly useful in an environment repeatedly subjected to dew condensation.

The invention claimed is:

1. A heat exchanger comprising:

a plurality of unit devices, each including:

a heat exchanger plate;

a spacer rib for keeping a spacing between the heat exchanger plate and an adjacent heat exchanger plate of an adjacent unit device; and a shielding rib for shielding leakage of airflow, wherein the spacer rib and the shielding rib are made of a resin having water-insolubility and a flame retardant property, the heat exchanger plate, the spacer rib and the shielding rib are integrally molded, the plurality of unit devices are stacked over each other to form airflow passages between the adjacent heat exchanger plates, the heat exchanger plate is made of a moisture permeable resin film having water-insolubility and a flame retardant property, the airflow passages allow a first airflow and a second airflow to pass therethrough and to exchange heat through the adjacent heat exchanger plates, and the moisture permeable resin film is a three-layer composite moisture permeable resin film formed by joining a hydrophilic moisture permeable resin film having water-insolubility, a flame retardant property, and a gas shielding property to one surface of a porous resin film having water-insolubility and a flame retardant property, and joining a porous resin substrate having water-insolubility, a flame retardant property, and breathability to an other surface of the porous resin film.

2. The heat exchanger of claim 1, wherein the porous resin substrate is made of a flame retardant unwoven cloth.

3. The heat exchanger of claim 2, wherein the porous resin substrate made of the flame retardant unwoven cloth is formed by kneading a flame retardant agent into resin fibers thereof.

4. A heat exchanger comprising:

a plurality of unit devices, each including:

a heat exchanger plate;

a spacer rib for keeping a spacing between the heat exchanger plate and an adjacent heat exchanger plate of an adjacent unit device; and a shielding rib for shielding leakage of airflow, wherein the spacer rib and the shielding rib are made of a resin having water-insolubility and a flame retardant property, the heat exchanger plate, the spacer rib and the shielding rib are integrally molded, the plurality of unit devices are stacked over each other to form airflow passages between the adjacent heat exchanger plates, the heat exchanger plate is made of a moisture permeable resin film having water-Insolubility and a flame retardant property, the airflow passages allow a first airflow and a second airflow to pass therethrough and to exchange heat through the adjacent heat exchanger plates, and the moisture permeable resin film is a three-layer composite moisture permeable resin film formed by joining a hydrophilic moisture permeable resin film having water-insolubility, a flame retardant property, and a gas shielding property to one surface of a porous resin film having water-insolubility and a flame retardant property, and joining a porous resin substrate having water-insolubility, a flame retardant property, and breathability to a surface of the hydrophilic moisture permeable resin film.

5. The heat exchanger of claim 4, wherein the hydrophilic moisture permeable resin film is a hydrophilic moisture permeable resin film having water-insolubility and a gas shielding property.

6. The heat exchanger of claim 4, wherein the three-layer composite moisture permeable resin film is formed by roughening a surface of the hydrophilic moisture permeable resin film and joining the porous resin substrate to the roughened surface of the hydrophilic moisture permeable resin film.

7. The heat exchanger of claim 6, wherein the roughened surface of the hydrophilic moisture permeable resin film is obtained by an electric discharge machining process.

8. The heat exchanger of claim 4, wherein the three-layer composite moisture permeable resin film is formed by spot-gluing the porous resin substrate to the surface of the hydrophilic moisture permeable resin film using a waterproof adhesive.

9. A heat exchanger comprising a plurality of heat exchanging plates stacked on top of each other, wherein each of the heat exchanging plates includes:

a plurality of first shielding ribs disposed at end portions on a first surface, and a plurality of first spacer ribs disposed within the first shielding ribs, the first spacing ribs and the first shielding ribs disposed in a first direction; and a plurality of second shielding ribs disposed at end portions on a second surface opposite to the first surface, and a plurality of second spacer ribs disposed within the second shielding ribs, the second spacer ribs and second shielding ribs disposed in a second direction offset from the first direction by a first predetermined angle, wherein the heat exchanging plates are stacked on top of each other in alternate directions offset by a second predetermined angle to thereby form first and second airflows which intersect at approximately the second predetermined angle to exchange heat between the heat exchanging plates, wherein each of the heat exchanger plates comprises a hydrophilic moisture permeable resin film having water-insolubility, a flame retardant property, and a gas shielding property joined to one surface of a porous resin film having water-insolubility and a flame retardant property, and wherein the heat exchanger further comprises a porous resin substrate having water-insolubility, a flame retardant property, and breathability joined to a surface of one of the hydrophilic moisture permeable resin film and the porous resin film.

10. The heat exchanger of claim 9, wherein the porous resin substrate comprises a flame retardant agent kneaded into resin fibers of a flame retardant unwoven cloth.

11. The heat exchanger of claim 10, wherein the first and second predetermined angles are substantially equal to 90 degrees.

* * * * *